US009673009B2

(12) United States Patent
Yang

(10) Patent No.: US 9,673,009 B2
(45) Date of Patent: Jun. 6, 2017

(54) DIRECT CURRENT RELAY

(71) Applicant: LSIS CO., LTD., Gyeonggi-do (KR)

(72) Inventor: Junhyuk Yang, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/260,081

(22) Filed: Sep. 8, 2016

(65) Prior Publication Data

US 2017/0110275 A1 Apr. 20, 2017

(30) Foreign Application Priority Data

Oct. 14, 2015 (KR) ..... 10-2015-0143623

(51) Int. Cl.
*H01H 3/00* (2006.01)
*H01H 50/30* (2006.01)
*H01H 50/58* (2006.01)

(52) U.S. Cl.
CPC ..... *H01H 50/305* (2013.01); *H01H 50/58* (2013.01)

(58) Field of Classification Search
CPC ..... H01H 50/54; H01H 50/56; H01H 50/64; H01H 50/18; H01H 50/44; H01H 50/645; H01H 50/04; H01H 50/10; H01H 50/305; H01H 50/30; H01F 2/0278
USPC ..... 335/185
See application file for complete search history.

(56) References Cited

U.S. PATENT DOCUMENTS 3,740,510 A 6/1973 Grunert
4,509,026 A * 4/1985 Matsushita ..... H01F 7/1615 335/132
5,892,422 A * 4/1999 Montaigu ..... H01H 51/065 335/126
5,986,529 A * 11/1999 Miyata ..... H01H 50/60 335/129
6,911,884 B2 * 6/2005 Uotome ..... H01H 47/06 335/132
7,852,178 B2 * 12/2010 Bush ..... H01H 51/2209 335/126
8,138,863 B2 * 3/2012 Tanaka ..... H01H 1/54 335/126
8,138,872 B2 * 3/2012 Yoshihara ..... H01F 7/1615 335/124

(Continued)

FOREIGN PATENT DOCUMENTS

EP 2341521 A1 7/2011
EP 2768002 A1 8/2014

(Continued)

OTHER PUBLICATIONS

Search Report from Korean App. No. 02-6915-6752 dated Oct. 8, 2015 in 4 pages.

(Continued)

*Primary Examiner* — Shawki S Ismail
*Assistant Examiner* — Lisa Homza
(74) *Attorney, Agent, or Firm* — Knobbe, Martens, Olson & Bear, LLP

(57) ABSTRACT

Disclosed embodiments relate to a direct current relay. In some embodiments, a direct current relay is capable of reducing noise by attenuating an impact generated between a fixed core and a moving core during an 'ON' operation, and by attenuating an impact generated between a shaft and a middle plate during an 'OFF' operation.

7 Claims, 7 Drawing Sheets

(56) References Cited

U.S. PATENT DOCUMENTS 8,179,217 B2 * 5/2012 Kawaguchi ..... H01F 7/1615 335/124
8,242,866 B2 8/2012 Eum
8,269,585 B2 * 9/2012 Choi ..... H01H 1/2008 335/126
8,330,565 B2 * 12/2012 Eum ..... H01H 51/065 335/126
8,552,824 B1 * 10/2013 Pal ..... H01H 50/043 335/185
8,653,913 B2 * 2/2014 Vellaiyanaicken .. H01H 1/2025 335/126
8,653,915 B2 * 2/2014 Schmidt ..... H01H 51/06 335/185
8,653,917 B2 * 2/2014 Takaya ..... H01H 9/443 335/126
9,076,620 B2 7/2015 Lee
2007/0241847 A1 * 10/2007 Yamamoto ..... H01H 50/305 335/196
2011/0156845 A1 6/2011 Eum
2011/0221548 A1 * 9/2011 Yoshihara ..... H01H 51/29 335/185
2012/0092095 A1 * 4/2012 Lim ..... H01H 50/546 335/185
2012/0092096 A1 * 4/2012 Choi ..... H01H 50/546 335/185
2012/0326815 A1 * 12/2012 Suzuki ..... H01H 50/546 335/185
2013/0021122 A1 * 1/2013 Uchida ..... H01H 1/54 335/131
2013/0057369 A1 * 3/2013 Yano ..... H01H 1/66 335/156
2013/0088312 A1 * 4/2013 Isonaga ..... H01H 50/20 335/192
2013/0214884 A1 * 8/2013 Ito ..... H01H 1/20 335/153
2013/0342293 A1 * 12/2013 Yamamoto ..... H01H 1/32 335/194
2014/0062627 A1 3/2014 Naka et al.
2014/0092517 A1 * 4/2014 Sora ..... H01H 50/44 361/160
2014/0232489 A1 * 8/2014 Kubono ..... H01H 50/54 335/83
2014/0232492 A1 8/2014 Lee
2014/0232493 A1 8/2014 Lee
2015/0002250 A1 1/2015 Kashimura et al.
2015/0022296 A1 * 1/2015 Takaya ..... H01H 50/04 335/201
2015/0054605 A1 * 2/2015 Kubono ..... H01H 50/60 335/177
2015/0077202 A1 3/2015 Enomoto et al.
2015/0187527 A1 * 7/2015 Kubono ..... H01H 50/44 361/206
2015/0194284 A1 * 7/2015 Uruma ..... H01H 1/06 335/179
2015/0213980 A1 * 7/2015 Lee ..... H01H 50/10 335/185
2015/0213981 A1 * 7/2015 Choi ..... H01H 50/32 335/185
2015/0213982 A1 * 7/2015 Lim ..... H01H 1/54 335/185
2015/0380194 A1 * 12/2015 Lee ..... H01H 50/041 335/192
2016/0155592 A1 * 6/2016 Ito ..... H01H 50/36 335/187
2016/0181038 A1 * 6/2016 Shimizu ..... H01H 50/44 335/165
2016/0225565 A1 * 8/2016 Sugisawa ..... H01H 50/16
2016/0233039 A1 * 8/2016 Kanematsu ..... H01H 1/66
2016/0260566 A1 * 9/2016 Shima ..... H01H 50/38

FOREIGN PATENT DOCUMENTS

JP 2007287526 A 11/2007
JP 2012243584 12/2012
JP 2013175437 9/2013
JP 2015046377 3/2015
JP 2015079672 4/2015
KR 101422394 7/2014
KR 20140145189 12/2014
KR 101545893 8/2015
WO WO 2013051264 4/2013

OTHER PUBLICATIONS

European Search Report issued on Feb. 9, 2017 for European Application No. 16183421, in 7 pages.

* cited by examiner

DIRECT CURRENT RELAY

CROSS-REFERENCE TO RELATED APPLICATIONS

This application claims the benefit of Korean Application No. 10-2015-0143623, filed on Oct. 14, 2015, which is hereby incorporated by reference in its entirety.

BACKGROUND

Technical Field

The present disclosure relates to relates to a relay, and more particularly, to a direct current relay capable of reducing noise by attenuating an impact generated between a fixed core and a moving core during an 'ON' operation, and by attenuating an impact generated between a shaft and a middle plate during an 'OFF' operation.

BACKGROUND

Generally, a direct current relay or a magnetic switch is a type of electric circuit switching device capable of executing a mechanical driving using a principle of an electromagnet, and capable of transmitting a current signal. The direct current relay or the magnetic switch is installed at various types of industrial equipment, machines, vehicles, etc.

Especially, an electric vehicle such as a hybrid car, a fuel cell car, a golf cart and an electronic forklift is provided with an electric vehicle relay for supplying power of a battery to a power generator and electric components or disconnecting power supply thereto. Such an electric vehicle relay is a very important core component of an electric vehicle.

FIGS. 1 and 2 are views illustrating a structure of a direct current relay in accordance with the conventional art, in which FIG. 1 illustrates an interrupted state ('OFF' state) and FIG. 2 illustrates a conducted state ('ON' state).

The conventional direct current relay includes: a pair of fixed contacts 2 fixedly-installed at an upper side of an arc chamber 1; a movable contact 3 installed in the arc chamber 1 so as to be linearly moveable, and moveable to contact or to be separated from the pair of fixed contacts 2; an actuator (A) installed below the arc chamber 1, and configured to linearly-move the movable contact 3; and a contact spring 4 configured to obtain a contact pressure of the movable contact 3.

The actuator (A) includes: a coil 5 configured to generate a magnetic field when an external power is applied thereto; a fixed core 6 fixedly-installed in the coil 5; a moving core 7 installed below the fixed core 6 so as to be moveable up and down; a shaft 8 having a lower end fixed to the moving core 7 and having an upper end slidably-coupled to the movable contact 3; and a return spring 9 installed between the fixed core 6 and the moving core 7, and configured to return the moving core 7 to a direction which becomes far from the fixed core 6. The shaft 8 is guided to slide through a shaft hole formed at a central part of the fixed core 6.

An operation of the conventional direct current relay will be explained as follows.

Firstly, an 'ON' operation of the conventional direct current relay will be explained.

If a current is applied to the coil 5 in an interrupted state shown in FIG. 1, a magnetic field is generated around the coil 5, and the fixed core 6 is magnetized within the magnetic field. The moving core 7 is upward moved by a magnetic suction force of the fixed core 6, with compressing the return spring 9. Further, the shaft 8 coupled to the moving core 7 is upward moved with compressing the contact spring 4, thereby upward-moving the movable contact 3 to contact the movable contact 3 to the fixed contact 2. As a result, a main circuit is in a conducted state. That is, the main circuit is in a conducted state as shown in FIG. 2.

However, in this case, as the moving core 7 and the fixed core 6 collide with each other, noise is generated.

Next, an 'OFF' operation of the conventional direct current relay will be explained.

If an interruption signal is generated in a conducted state shown in FIG. 2, a current flowing on the coil 5 is interrupted and a magnetic field disappears. As a result, the magnetic suction force of the fixed core 6 is removed. Accordingly, the moving core 7 is rapidly downward-moved by a restoration force of each of the return spring 9 and the contact spring 4. Further, as the movable contact 3 is separated from the fixed contact 2 while the shaft 8 is downward moved, the main circuit is in an interrupted state as shown in FIG. 1.

However, the downward movement of the shaft 8 is stopped as a protrusion 8*a* formed at an intermediate part of the shaft 8 collides with a plate la or a pad plate 1*b*. In this case, noise is generated due to an impact.

Quality of the direct current relay may be degraded due to noise generated when the moving core 7 and the fixed core 6 collide with each other during an 'ON' operation, and noise generated when the shaft 8 and the plates 1*a*, 1*b* collide with each other during an 'OFF' operation.

SUMMARY

Therefore, an aspect of some embodiments of the detailed description is to provide a direct current relay capable of reducing noise by attenuating an impact generated between a fixed core and a moving core during an 'ON' operation, and by attenuating an impact generated between a shaft and a middle plate during an 'OFF' operation.

To achieve these and other advantages and in accordance with the purpose of this specification, as embodied and broadly described herein, there is provided a direct current relay, including: a pair of fixed contacts fixedly-installed at one side of a frame; a movable contact installed below the pair of fixed contacts so as to be linearly moveable, and moveable to contact or to be separated from the pair of fixed contacts; a middle plate installed below the movable contact; a contact spring provided between the movable contact and the middle plate; a fixed core installed at the middle plate, and including a center through which a shaft hole passes; a moving core installed below the fixed core so as to be linearly moveable; a shaft including an upper end where a mounting portion protruding to an upper side of the movable contact is formed, and including a lower end coupled to the movable core; and a tension spring installed between the movable contact and the mounting portion.

In some embodiments, a jaw portion may be formed at the millde plate, and a flange portion mounted on the jaw portion may be formed at an upper part of the fixed core.

In some embodiments, an insulating plate may be provided between the movable contact and the middle plate, and a lower end of the contact spring may be installed at the insulating plate.

In some embodiments, an elastic member may be provided on the fixed core.

In some embodiments, the shaft may be formed as a straight-shaped shaft, and the mounting portion may be configured as a flange.

In some embodiments, the direct current relay may further include a return spring including a lower end fixed to a spring groove formed at an upper part of the movable core, including an intermediate part which passes through the shaft hole of the fixed core, and including an upper end fixed to the elastic member.

When an external force is not applied to the direct current relay in an interrupted state, if the tension spring and the contact spring are in a force balanced state, the movable contact may be in a separated state from the fixed contact.

The direct current relay according to some embodiments of the present disclosure may include the following advantages.

Firstly, since the fixed core is inserted into the middle plate from the upper side with a gap to upward move, collision between the fixed core and the moving core may be attenuated during an 'ON' operation. This may reduce noise.

Secondly, since the shaft does not include the conventional intermediate protrusion, the shaft may not collide with the middle plate during an 'OFF' operation. As a result, noise may not be generated.

Further, since the tension spring is provided at an upper part of the shaft, a contact pressure required between the fixed contact and the movable contact may be maintained.

Further scope of applicability of the present application will become more apparent from the detailed description given hereinafter. However, it should be understood that the detailed description and specific examples, while indicating embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate embodiments and together with the description serve to explain the principles of the disclosure.

In the drawings:

FIGS. 1 and 2 are views illustrating a structure of a direct current relay in accordance with the prior art, in which FIG. 1 illustrates an interrupted state ('OFF' state) and FIG. 2 illustrates a conducted state ('ON' state);

FIGS. 3 and 4 are views illustrating a structure of a direct current relay according to some embodiments of the present disclosure, in which FIG. 3 illustrates an interrupted state and FIG. 4 illustrates a conducted state; and FIGS. 5 to 7 are views illustrating an operation of a direct current relay according to some embodiments of the present disclosure, in which FIG. 5 illustrates an interrupted state, FIG. 6 illustrates a contact state between a movable contact and a fixed contact during an 'ON' operation, and FIG. 7 illustrates a completed state of an 'ON' operation.

DETAILED DESCRIPTION

Description will now be given in detail of configurations of a direct current relay according to some embodiments of the present disclosure, with reference to the accompanying drawings.

Figure 1:
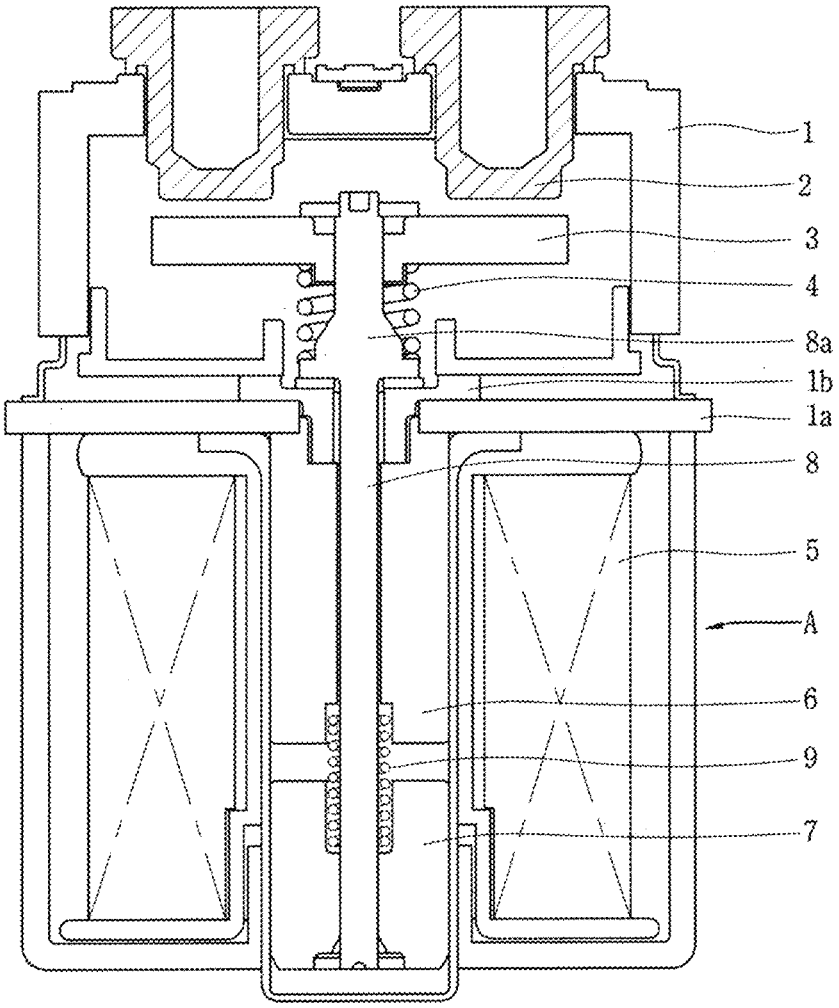
Fig. 1 Prior Art
Figure 2:
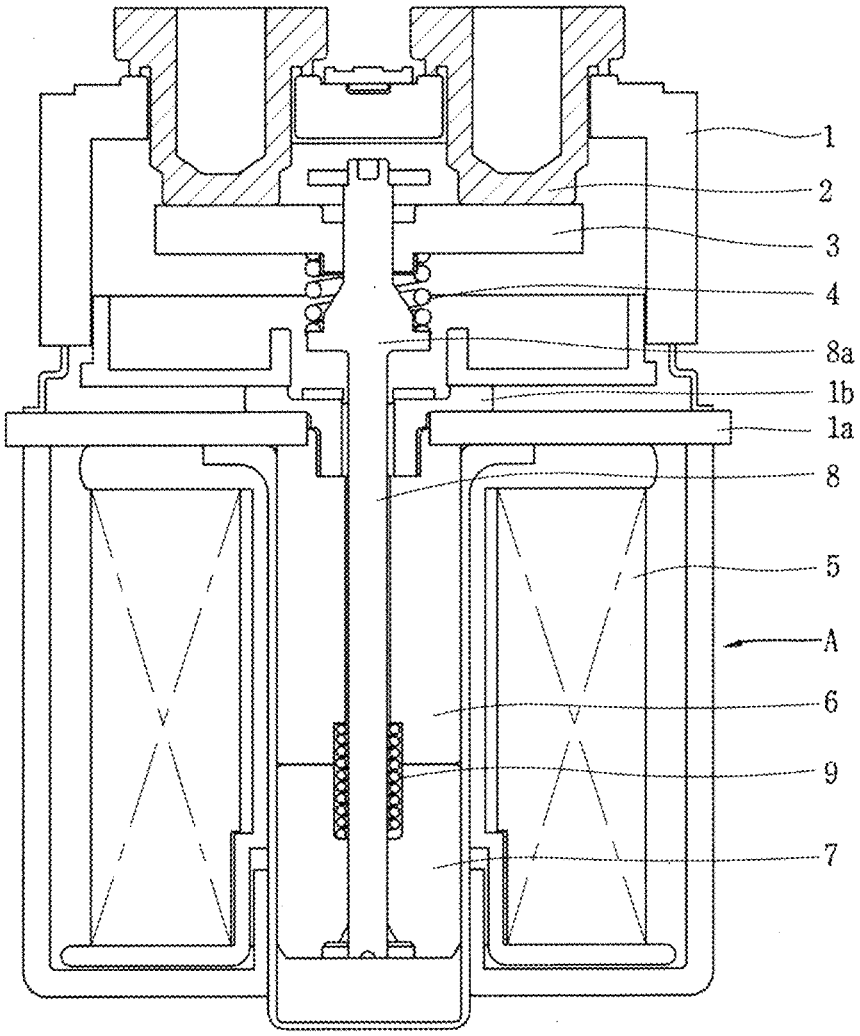
Fig. 2 Prior Art
Figure 3:
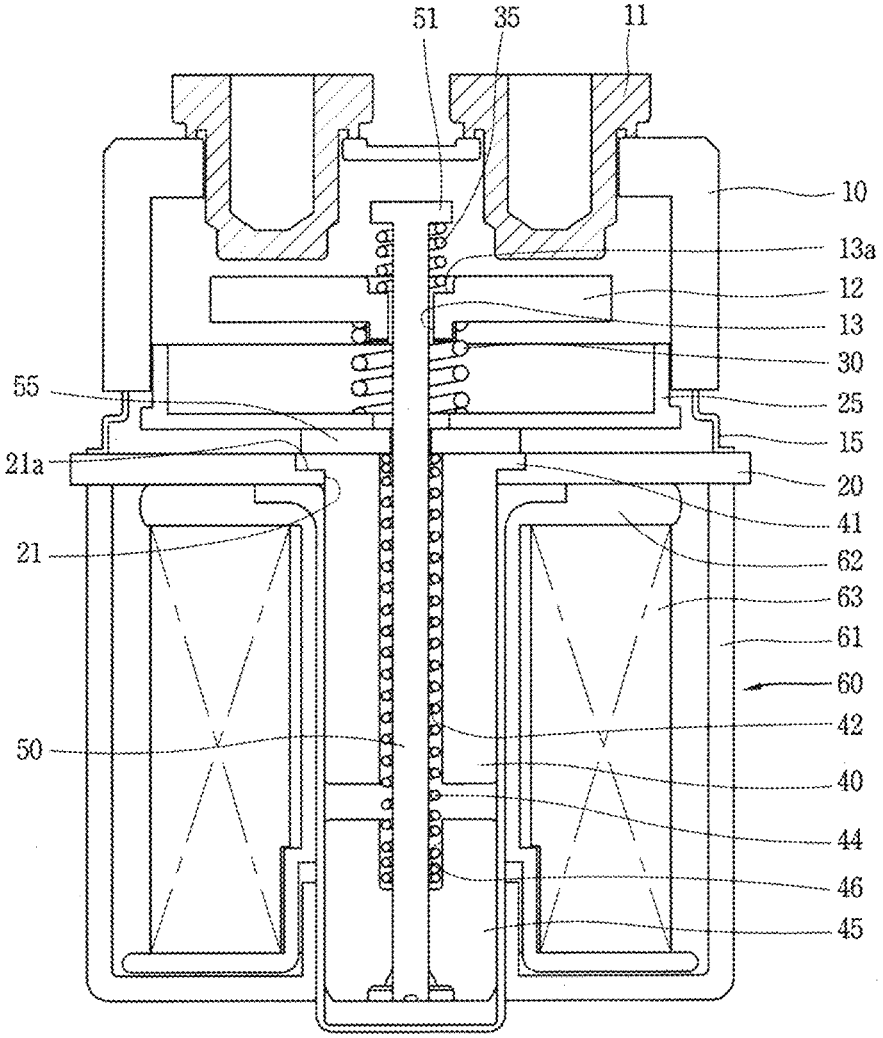
Figure 4:
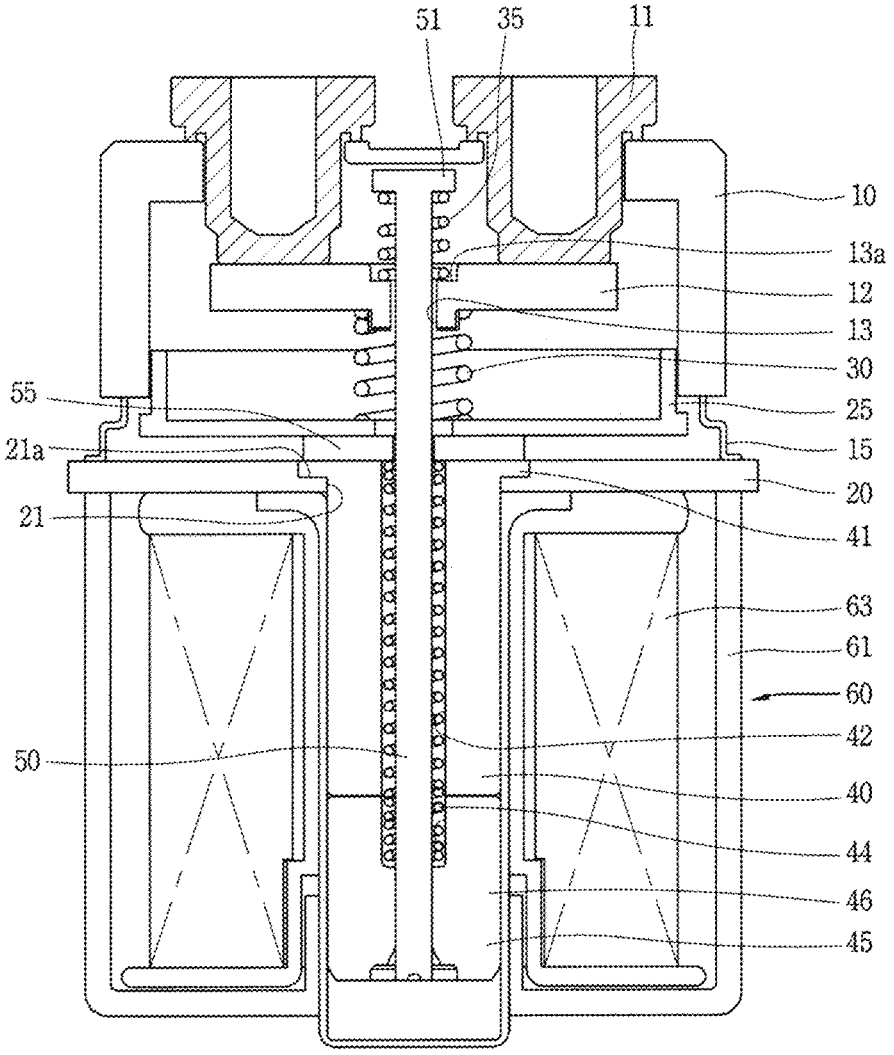

FIGS. 3 and 4 are views illustrating a structure of a direct current relay according to some embodiments of the present disclosure, in which FIG. 3 illustrates an interrupted state ('OFF' state) and FIG. 4 illustrates a conducted state ('ON' state).

A direct current relay according to some embodiments of the present disclosure will be explained in more detail with reference to the attached drawings.

A direct current relay according to some embodiments of the present disclosure includes a pair of fixed contacts 11 fixedly-installed at one side of a frame; a movable contact 12 installed below the pair of fixed contacts 11 so as to be linearly moveable, and moveable to contact or to be separated from the pair of fixed contacts 11; a middle plate 20 installed below the movable contact 12; a contact spring 30 provided between the movable contact 12 and the middle plate 20; a fixed core 40 insertion-installed at a center hole 21 of the middle plate 20, and including a center through which a shaft hole 42 passes; a moving core 45 installed below the fixed core 40 so as to be linearly moveable; a shaft 50 including an upper end where a mounting portion 51 protruding to an upper side of the movable contact 12 is formed, and including a lower end coupled to the moving core 45; and a tension spring 35 installed between the movable contact 12 and the mounting portion 51.

Although not shown, the frame is formed as a box-shaped case for mounting therein and supporting the components shown in FIG. 3.

The arc chamber 10 includes a box shape of which lower surface is open, and is installed at an inner upper side of the frame. The arc chamber 10 is formed of a material including an excellent insulating property, pressure-resistance and heat-resistance, such that an arc generated from a contact part during a circuit interrupting operation is extinguished.

The fixed contacts 11 are provided in one pair, and are fixedly-installed at the frame (not shown) and the arc chamber 10. One of the fixed contacts 11 may be connected to a power side, and another thereof may be connected to a load side.

The movable contact 12 is formed as a plate body including a predetermined length, and is installed below the pair of fixed contacts 11. The movable contact 12 may be linearly movable up and down by an actuator 60 installed at an inner lower side of the relay, thereby contacting the fixed contacts 11 or being separated from the fixed contacts 11.

The actuator 60 may include a yoke 61 including a 'U'-shape and forming a magnetic circuit; a coil 63 wound on a bobbin 62 installed in the yoke 61, and generating a magnetic field by receiving an external power; a fixed core 40 fixedly-installed in the coil 63, magnetized by a magnetic field generated by the coil 63, and generating a magnetic suction force; a moving core 45 installed below the fixed core 40 so as to be linearly movable, and moveable to contact or to be separated from the fixed core 40 by the magnetic suction force of the fixed core 40; a shaft 50 including a lower end coupled to the moving core 45, and including an upper end slidably inserted into the movable contact 12; and a return spring 44 installed between the fixed core 40 and the moving core 45, and configured to downward restore the moving core 45.

The middle plate 20 is provided between the actuator 60 and the arc chamber 10. The middle plate 20 may be coupled to an upper part of the yoke 61. The middle plate 20 may be formed of a magnetic substance to form a magnetic path. And the middle plate 20 may serve as a supporting plate to which the arc chamber 10 positioned at the upper side and the actuator 60 positioned at the lower side are installed.

A sealing member may be provided between the middle plate 20 and the arc chamber 10. That is, a sealing cover member 15 may be provided along a lower circumference of the arc chamber 10.

The contact spring 30 is provided between the movable contact 12 and the middle plate 20. The contact spring 30 is provided to support the movable contact 12, and to provide a contact pressure to the movable contact 12 in a conducted state. The contact spring 30 may be configured as a compression coil spring.

An insulating plate 25 may be provided between the arc chamber 10 and the middle plate 20 in order to ensure insulating performance. The insulating plate 25 may be installed to cover a lower surface of the arc chamber 10, and may be spaced from the middle plate 20 by a predetermined distance. In the case where the insulating plate 25 is provided, the contact spring 30 may be installed between the insulating plate 25 and the movable contact 12.

The fixed core 40 may be installed at the middle plate 20 by being inserted from the upper side. In the conventional art, a fixed core is installed to be fixed to a lower part of a middle plate. In this case, when the fixed core 40 collides with a movable core, noise occurs. In order to solve the conventional problem, the fixed core 40 is installed on the middle plate 20 in a fitted manner, so as to be upward movable.

As some embodiments to enable a movement of the fixed core 40, a jaw portion 21*a* may be formed at the center hole 21 of the middle plate 20, and a flange portion 41 mounted on the jaw portion 21*a* may be formed at an upper part of the fixed core 40. That is, the fixed core 40 is positioned on the middle plate 20 to thus be moveable upward. With such a configuration, when the fixed core 40 collides with the moving core 45, the fixed core 40 upward moves a little to reduce an impulse and noise.

An elastic member 55 is provided on the fixed core 40. The elastic member 55 may be installed on the middle plate 20. As the elastic member 55 is disposed on the fixed core 40, when the fixed core 40 is upward moved, an impact of the fixed core 40 is reduced by the elastic member 55. This may reduce noise. The elastic member 55 may be formed of a soft material such as rubber or a synthetic resin.

The shaft 50 is formed as a straight-shaped bar. The shaft 50 is moved together with the moving core 45 when the moving core 45 is moved, as a lower end of the shaft 50 is fixedly-coupled to the moving core 45. The shaft 50 is penetratingly-installed at the fixed core 40, the elastic member 55, the insulating plate 25 and the movable contact 12, in a slidable manner. Part of the shaft 50 is exposed to an upper side of the movable contact 12. The shaft 50 is formed not to include the conventional intermediate protrusion for mounting the contact spring 30, and is formed in a straight-shape. Accordingly, the shaft 50 does not collide with the middle plate 20 in an interrupted state, and thus noise is not generated.

The mounting portion 51 for installing the tension spring 35 is formed at an upper end of the shaft 50. The mounting portion 51 may be formed as a flange.

The tension spring 35 is provided between the mounting portion 51 of the shaft 50 and the movable contact 12. An upper end of the tension spring 35 is fixed to the mounting portion 51 of the shaft 50, and a lower end of the tension spring 35 is fixed to an upper part of the movable contact 12. In some embodiments, a locking groove 13*a* may be formed at an upper part of a through hole 13 of the movable contact 12, and the lower end of the tension spring 35 may be fixed to the locking groove 13*a*.

The tension spring 35 may be formed as a tension coil spring. With such a configuration, when the shaft 50 is upward moved in a conducted state, a force to lift up the movable contact 12 is generated, and thus a contact pressure is provided to the movable contact 12.

If an external force is not applied to the direct current relay in an interrupted state shown in FIG. 3, the movable contact 12 is positioned on a force balance point between the contact spring 30 and the tension spring 35. In this case, a length of the contact spring 30 and the tension spring 35, a spring constant, etc. should be designed such that the movable contact 12 is disposed on a position separated from the fixed contact 11.

A return spring 44 is provided to restore the moving core 45. The return spring 44 may be formed as a compression coil spring. A lower end of the return spring 44 may be fixed to a spring groove 46 formed at an upper part of the moving core 45, and an upper end of the return spring 44 may be fixed to a spring groove (not shown) formed at a lower part of the fixed core 40. In some embodiments, the return spring 44 may be installed such that its upper end may be fixed to the elastic member 55 via the shaft hole 42 of the fixed core 40.

A constant of the return spring 44 may be set to be larger than that of the tension spring 35 or the contact spring 30. With such a configuration, a downward movement of the shaft 50 due to a restoration force of the return spring 44 in an interrupted state may be executed rapidly.

An operation of the direct current relay according to some embodiments of the present disclosure will be explained.

Firstly, an 'ON' operation of the direct current relay will be explained with reference to FIGS. 3 and 4.

If an external power is applied to the direct current relay in an interrupted state shown in FIG. 3, a magnetic field is generated around the coil 63, and the fixed core 40 is magnetized. The moving core 45 is attracted to the fixed core 40 to collide with the fixed core 40, by a magnetic suction force of the fixed core 40. An impact generated when the moving core 45 contacts the fixed core 40 is partially absorbed while the fixed core 40 is upward moved by a predetermined distance with compressing the elastic member 55. As a result, an impulse is reduced to reduce noise (refer to FIG. 4).

An operation of the direct current relay according to some embodiments of the present disclosure will be explained in more detail with reference to FIGS. 5 to 7.

Figure 5:
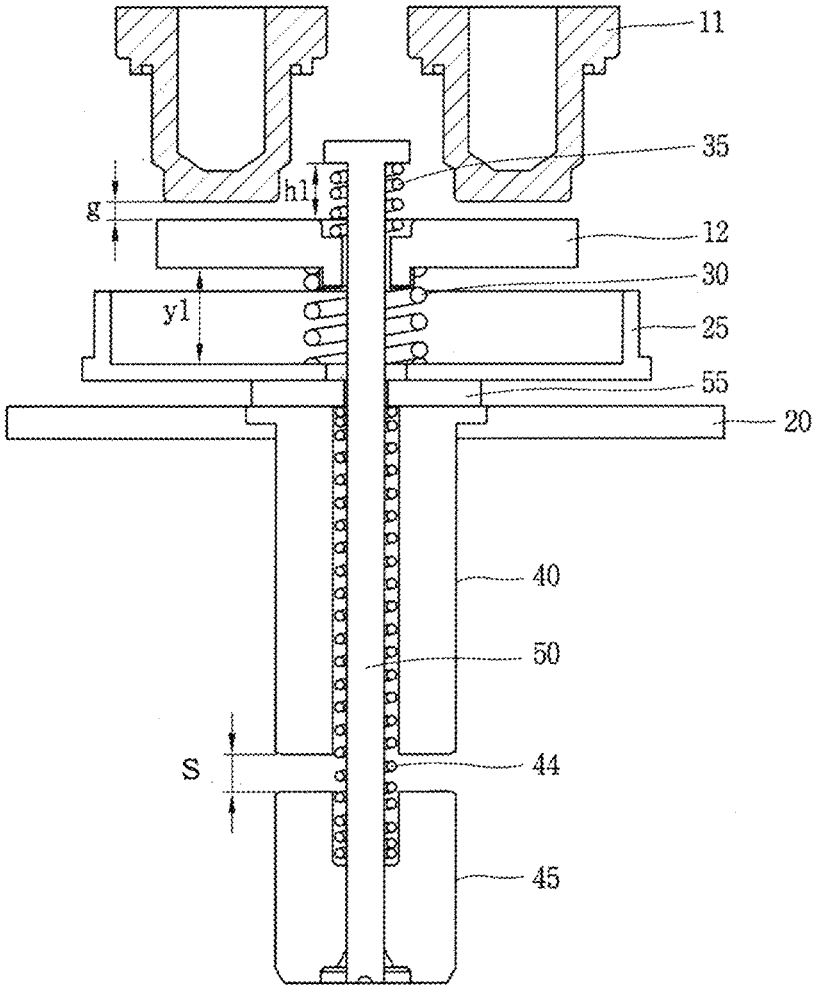
Figure 6:
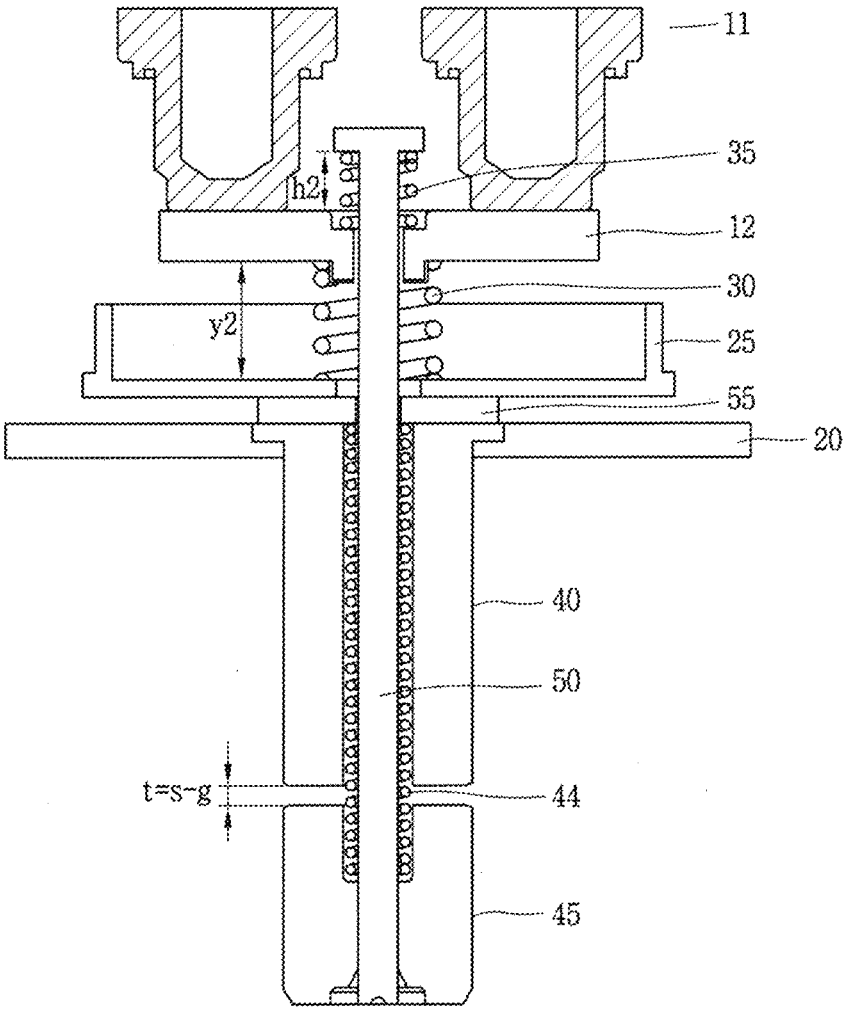
Figure 7:
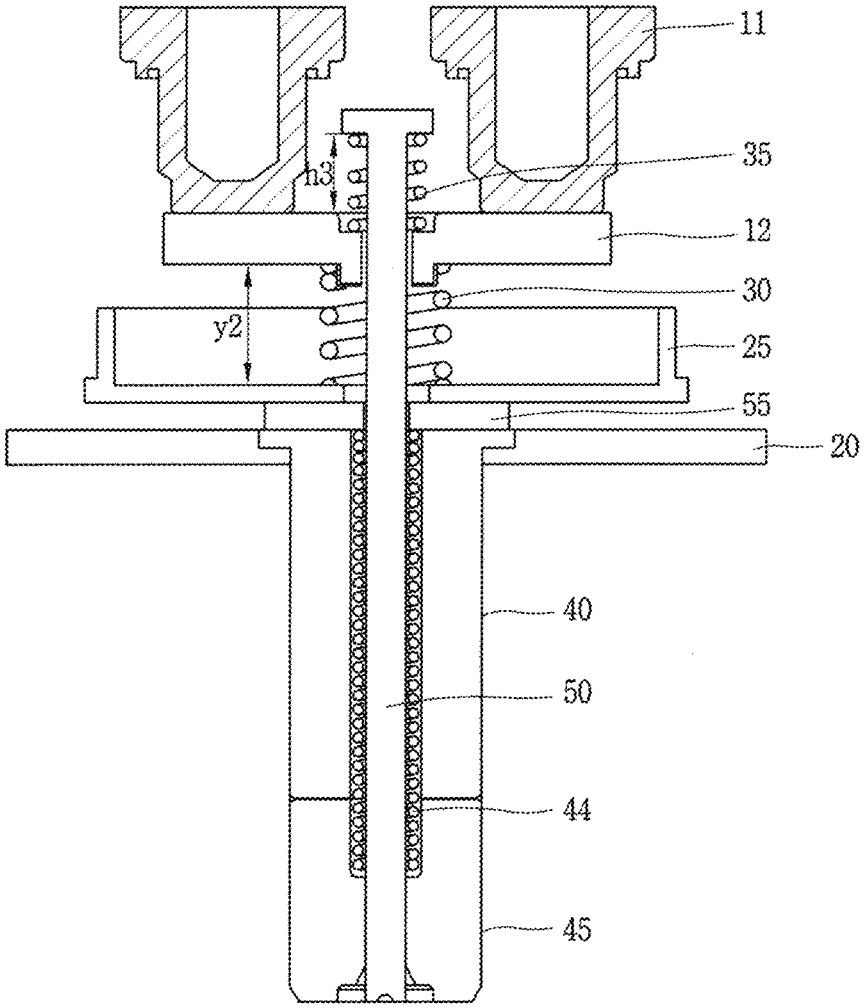

FIGS. 5 to 7 illustrate only main components for explanations of the operation of the direct current relay.

During an 'ON' operation, the movable contact 12 is upward moved as a force balance point between the contact spring 30 and the tension spring 35 is upward moved, as the shaft 50 coupled to the moving core 45 is upward moved. That is, if an external power is not applied to the direct current relay as in an interrupted state, the movable contact 12 is positioned on a force balance point between the contact spring 30 and the tension spring 35 (refer to FIG. 5). In this case, if the shaft 50 is upward moved by an external power, the contact spring 30 and the tension spring 35 are elongated to lift up the movable contact 12. The contact spring 30 and the tension spring 35 are elongated with storing an elastic force therein (refer to FIGS. 6 and 7). FIG. 6 illustrates a contacted state between the movable contact 12 and the fixed contact 11 as the shaft 50 is upward moved by 'g' during an 'ON' operation of the direct current relay. FIG. 7 illustrates a contacted state between the moving core 45 and the fixed core 40, as the shaft 50 is more upward moved bt 't' in the contacted state between the movable contact 12 and the fixed contact 11.

It is assumed that a coefficient of the contact spring 30 is 'k1', a coefficient of the tension spring 35 is 'k2', a distance (stroke) between the fixed core 40 and the moving core 45 is 's', and a distance (gap) between the fixed contact 11 and the movable contact 12 is 'g'. Under such an assumption, an over travel (t) for providing a contact pressure is 's−g' (t=s−g). In the conventional art, a contact pressure (f) is k1*t (f=k1*t).

When the movable contact 12 contacts the fixed contact 11 as shown in FIG. 6, a force balance equation (f1) between the contact spring 30 and the tension spring 35 is obtained as follows.

$$f1=k1*(y2-y1)=k2*(h2-h1)$$

Here, y1 and y2 denote an initial length and an elongated length of the contact spring 30, respectively. And h1 and h2 denote an initial length and an elongated length of the tension spring 35, respectively.

If the moving core 45 contacts the fixed core 40 as the 'ON' operation is completed as shown in FIG. 7, a force (f2) applied to the tension spring 35 is k2*(h3−h1) (f2=k2*(h3−h1)).

In this case, the contact pressure of some embodiments of the present disclosure is obtained as follows.

$$f=f2-f1=k2*(h3-h1)-k1*(y2-y1)$$

Here, since 's' is equal to 'h3−h1' and 'g' is equal to 'y2−y1', the contact pressure (f) is k2*s−k1*g (S=h3−h1, g=y2−y1, f=k2*s−k1*g). If 'k1' is equal to 'k2', the contact pressure (f) is k2*s−k1*g=k1*(s−g)=k1*t. In this case, since the contact pressure is equal to that of the conventional art, there is no loss of the contact pressure. That is, in a conducted state shown in FIG. 7, the same level of contact pressure may be maintained at the movable contact 12. Substantially, a standard of the shaft proper within a limited space of the arc chamber may be designed by controlling an amount of the contact pressure by properly combining the constant of the contact spring 30 with that of the tension spring 35.

Finally, as the moving core 45 contacts the fixed core 40, the movable contact 12 provides the contact pressure to the fixed contact 11. As a result, a main circuit is in a conducted state.

Next, an 'OFF' operation of the direct current relay will be explained.

If an interruption signal is input to the direct current relay in a conducted state shown in FIG. 4, a current flowing on the coil 63 is interrupted. Accordingly, a peripheral magnetic field disappears, and a magnetic suction force of the fixed core 40 is lost. As a result, the moving core 45 is made to return downward by a restoration force of the return spring 44, the contact spring 30 and the tension spring 35 (refer to FIG. 3). In this case, the shaft 50 does not collide with the middle plate 20 since it is formed to include a straight shape. Accordingly, noise is not generated.

The direct current relay according to some embodiments of the present disclosure may include the following advantages.

Firstly, since the fixed core is inserted into the middle plate from the upper side with a gap to upward move, collision between the fixed core and the moving core is attenuated during an 'ON' operation. This may reduce noise.

Secondly, since the shaft does not include the conventional intermediate protrusion, the shaft does not collide with the middle plate during an 'OFF' operation. As a result, noise is not generated.

Further, since the tension spring is provided at an upper part of the shaft, a contact pressure required between the fixed contact and the movable contact may be maintained.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims. While certain embodiments have been described, these embodiments have been presented by way of example only, and are not intended to limit the scope of the protection. Indeed, the novel methods and systems described herein may be embodied in a variety of other forms. Furthermore, various omissions, substitutions and changes in the form of the methods and systems described herein may be made without departing from the spirit of the protection. The accompanying claims and their equivalents are intended to cover such forms or modifications as would fall within the scope and spirit of the protection. Various components illustrated in the figures may be implemented as hardware and/or software and/or firmware on a processor, ASIC/FPGA, dedicated hardware, and/or logic circuitry. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A direct current relay, comprising:

a pair of fixed contacts fixed on one side of a frame;

a movable contact disposed below the pair of fixed contacts configured to move linearly, and configured to contact the pair of fixed contacts or to be separated from the pair of fixed contacts;

a middle plate disposed below the movable contact;

a contact spring disposed between the movable contact and the middle plate;

a fixed core disposed at the middle plate, and including a center with a shaft hole;

a movable core disposed below the fixed core and configured to move linearly;

a shaft including an upper end forming a mounting portion protruding to an upper side of the movable contact, and including a lower end coupled to the movable core; and a tension spring disposed between the movable contact and the mounting portion.

2. The direct current relay of claim 1, further comprising a jaw portion formed at the middle plate, and a flange portion mounted on the jaw portion and formed at an upper part of the fixed core.

3. The direct current relay of claim 1, further comprising an insulating plate disposed between the movable contact and the middle plate, and a lower end of the contact spring disposed on the insulating plate.

4. The direct current relay of claim 1, further comprising an elastic member disposed on the fixed core.

5. The direct current relay of claim 1, wherein the shaft comprises a straight-shaped shaft, and the mounting portion comprises a flange.

6. The direct current relay of claim 4, further comprising a return spring including:

a lower end fixed to a spring groove and formed at an upper part of the movable core, an intermediate part which is configured to pass through the shaft hole of the fixed core, and an upper end fixed to the elastic member.

7. The direct current relay of claim 1, wherein when an external force is not applied to the direct current relay in an interrupted state, if the tension spring and the contact spring are in a force balanced state, the movable contact is configured to be separated from the two fixed contacts.

* * * * *